US006667447B2

(12) United States Patent
Liu et al.

(10) Patent No.: US 6,667,447 B2
(45) Date of Patent: Dec. 23, 2003

(54) BUTTON DEVICE IN COMPUTER BEZEL

(75) Inventors: Yu Tai Liu, Taipei (TW); Alvin Liu, Taipei (TW); Yun Lung Chen, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/037,878

(22) Filed: Jan. 7, 2002

(65) Prior Publication Data

US 2003/0127307 A1 Jul. 10, 2003

(51) Int. Cl.[7] ..... H01H 13/14

(52) U.S. Cl. ..... 200/5 R; 200/4; 200/6 A; 200/17 R; 200/18; 200/296

(58) Field of Search ..... 200/5 R, 4, 6 A, 200/17 R, 18, 296

(56) References Cited

U.S. PATENT DOCUMENTS 5,862,071 A * 1/1999 Scholder ..... 365/52

* cited by examiner

*Primary Examiner*—Elvin Enad
*Assistant Examiner*—Jennifer A. Poker
(74) *Attorney, Agent, or Firm*—Wei Te Chung

(57) ABSTRACT

A button device includes a button (20), a spring (40) and a receiving portion (62) formed in a bezel (60). The button has a base (22), a plurality of locking hooks (24) and contacting blocks (26) extending rearwardly from a periphery of a back of the base, and a contacting pole (28) extending rearwardly from a middle of the back of the base. An annular guiding sleeve (30) is formed on the back of the base, and the spring is placed over the guiding sleeve. A plurality of apertures (64) is defined in a rearmost part of the receiving portion, for extension of the locking hooks. A plurality of holes (66, 68) is defined in the rearmost part of the receiving portion, for extension of the contacting blocks and contacting pole. An annular groove (70) is defined in the rearmost part of the receiving portion, for accommodating the guiding sleeve.

18 Claims, 5 Drawing Sheets

BUTTON DEVICE IN COMPUTER BEZEL

BACKGROUND OF THE INVENTION

1. Field of the Invention

The present invention relates to button devices, and particularly to button devices which are adapted to be incorporated into computer bezels.

2. Prior Art

Many electronic products have bezels attached to their front faces. Any typical product among a variety of electronic products has a variety of controlling buttons attached to its bezel. A contacting pole protrudes from the back of each button, for switching on the appropriate controlling circuit when the button is pushed. A spring is placed around each contacting pole, to enable the button to return to its original position.

As electronic products have improved rapidly, they have included more and more functions. Accordingly, more and more controlling buttons are needed on bezels of these products. Too many buttons crowd out limited space available on bezels.

To overcome this problem, a multi-function button device has been developed. Referring to FIG. 5, a large button 100 is attached to a bezel 200. A face of the large button 100 forms a plurality of functional zones. A functional symbol 102 is shown on each functional zone. A through hole 104 is defined in a middle of the large button 100, for extension of a small button 106 therethrough. A plurality of locking hooks 108 is formed at rearmost extremities of the large button 100 and rearmost extremities of the small button 106. A contacting pole 110 protrudes rearwardly from a rear of each functional symbol 102. Another contacting pole 112 protrudes rearwardly from a back of the small button 106. Each contacting pole 112 has a spring 114 placed thereover. An indented receiving portion 202 is formed in the bezel 200, for accommodating the large button 100 and the small button 106. A plurality of apertures 204 is defined in a rearmost part of the receiving portion 202, for extension therethrough of the locking hooks 108 of the large button 100 and of the small button 106. The large button 100 and the small button 106 are thereby attached to the bezel 200. Depressing one of the functional zones 102 of the large button 100 or the small button 106 drives the corresponding contacting pole 110 or 112 to switch on the appropriate controlling circuit. Unfortunately, assembly of the button device is unduly complicated. In addition, the need for a plurality of springs unduly inflates production costs.

A simplified button device which overcomes the above-mentioned problems is desired.

BRIEF SUMMARY OF THE INVENTION

Accordingly, an object of the present invention is to provide a simplified button device.

Another object of the present invention is to provide a button device which is readily incorporated in a bezel.

To achieve the above-mentioned objects, a button device in accordance with the present invention comprises a button, a spring and a receiving portion formed in a bezel. The button has a base, a plurality of locking hooks and contacting blocks extending rearwardly from a periphery of a back of the base, and a contacting pole extending rearwardly from a middle of the back of the base. An annular guiding sleeve is formed on the back of the base, and the spring is placed over the guiding sleeve. A plurality of apertures is defined in a rearmost part of the receiving portion, for extension of the locking hooks thereinto. A plurality of holes is defined in the rearmost part of the receiving portion, for extension of the corresponding contacting blocks and the contacting pole thereinto. An annular groove is defined in the rearmost part of the receiving portion, for accommodating the guiding sleeve. invention will be drawn from the following detailed description of a preferred embodiment of the present invention with the attached drawings, in which:

DESCRIPTION OF THE PREFERRED EMBODIMENTS

Figure 1:
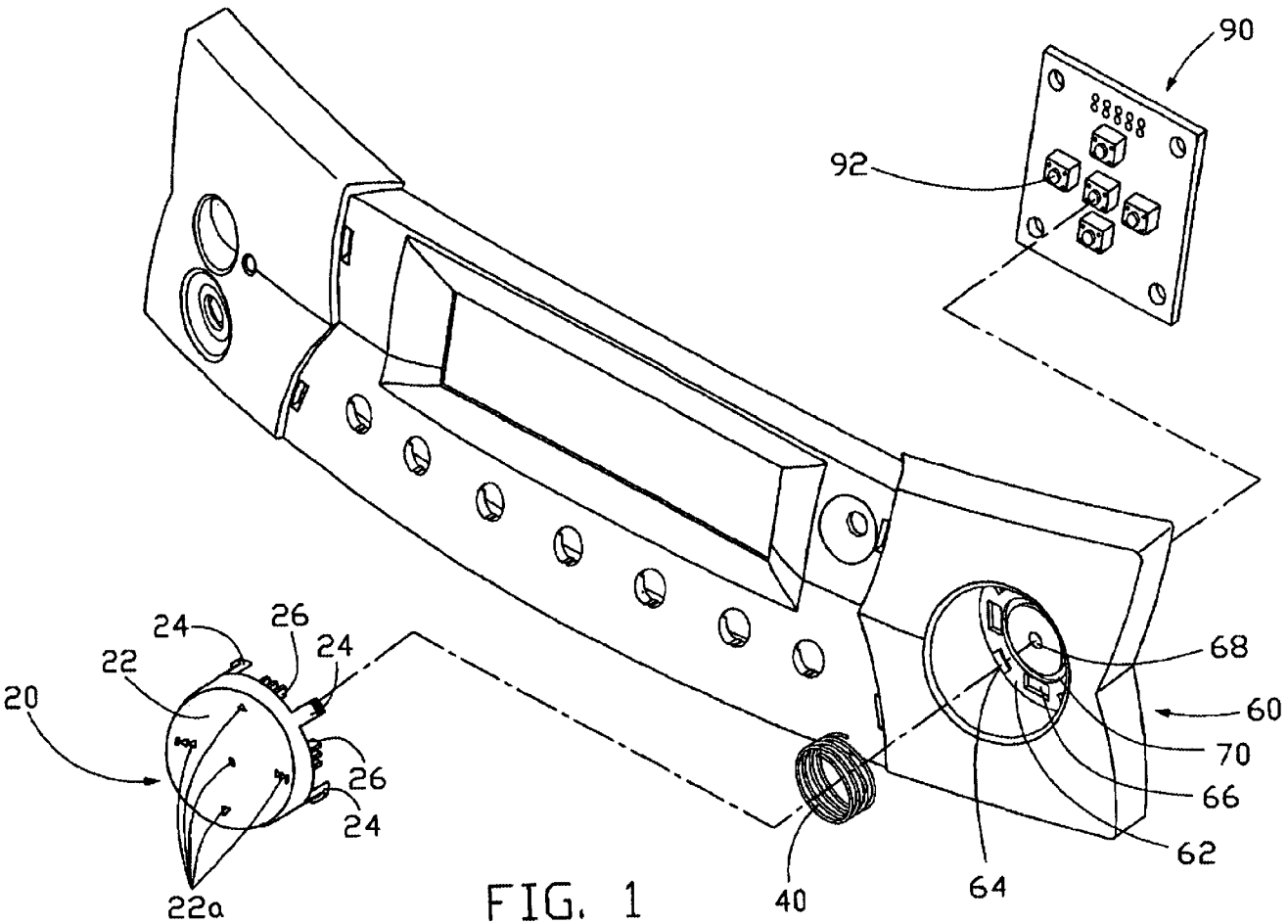
FIG. 1 is an exploded view of a button device in accordance with a preferred embodiment of the present invention, together with a computer bezel and a circuit board.

Referring to FIG. 1, a button device in accordance with a preferred embodiment of the present invention comprises a button 20, a spring 40 and an indented receiving portion 62 formed in a bezel 60. A circuit board 90 has a plurality of controlling points 92 formed thereon.

Figure 2:
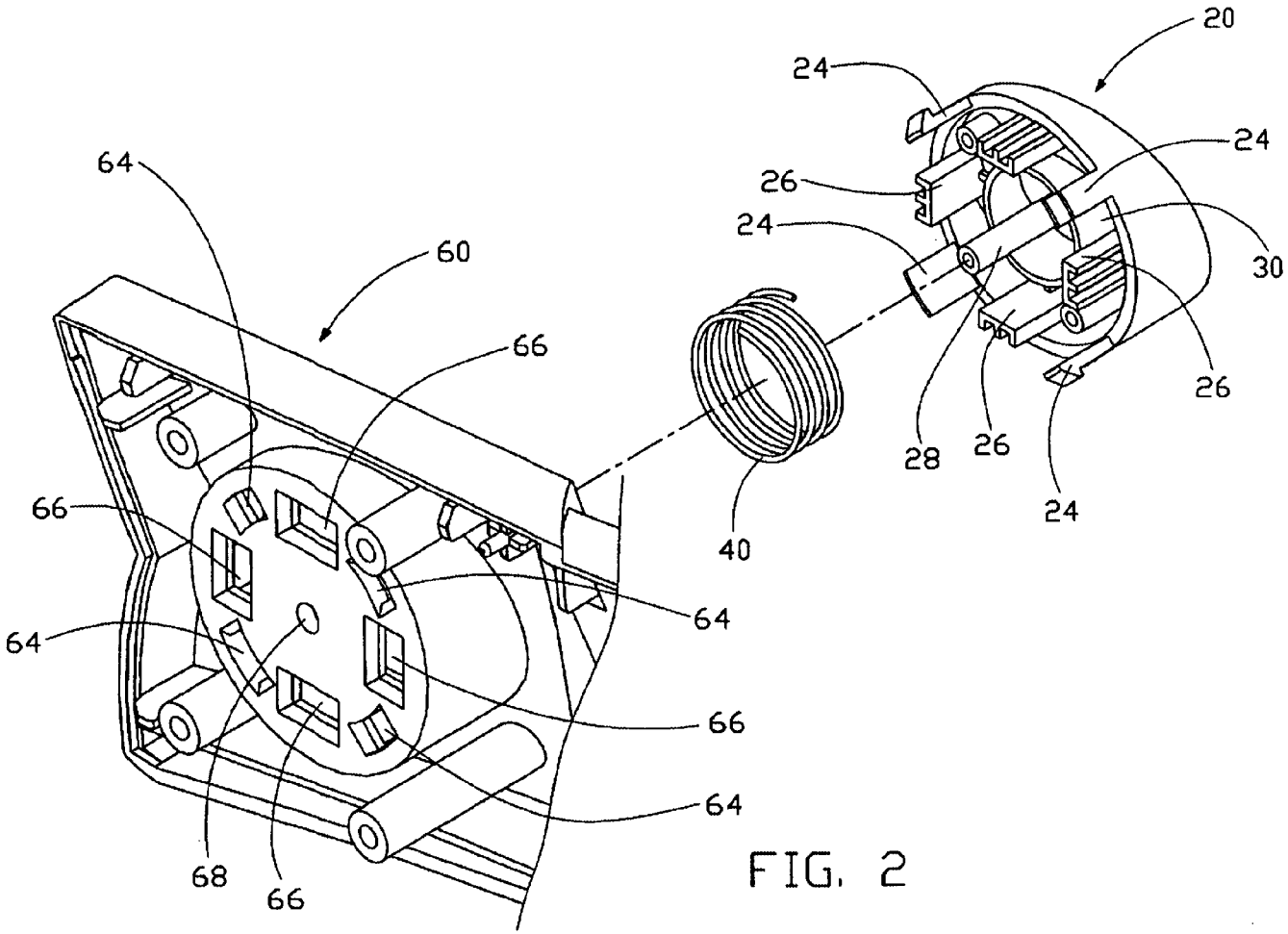
FIG. 2 is an exploded view of the button device of FIG. 1, but viewed from another aspect.

Referring also to FIG. 2, the button 20 has a base 22. Four locking hooks 24 extend rearwardly from a periphery of a back wall of the base 22. Four contacting blocks 26 extend rearwardly from the periphery of the back wall of the base 22. A contacting pole 28 extends rearwardly from a middle of the back wall of the base 22. Each of the contacting blocks 26 and the contacting pole 28 corresponds to one controlling point 92 of the circuit board 90. The contacting pole 28 is longer than the contacting blocks 26. An annular guiding sleeve 30 extends rearwardly from a middle portion of the back wall of the base 22, and surrounds part of the contacting pole 28. A plurality of functional symbols 22*a* is formed on a face of the base 22, corresponding to the contacting blocks 26 and the contacting pole 28.

The receiving portion 62 is formed in a front face of the bezel 60, for accommodating the button 20. Four locking apertures 64 are defined in a rearmost part of the receiving portion 62, for extension of the locking hooks 24 of the button 20 thereinto. Four holes 66 are defined in the rearmost part of the receiving portion 62, for extension of the contacting blocks 26 of the button 20 thereinto. A through hole 68 is defined in a middle of the rearmost part of the receiving portion 62, for extension of the contacting pole 28 thereinto. An annular groove 70 is defined in the rearmost part of the receiving portion 62, for accommodating the annular sleeve 30 of the button 20.

Figure 3:
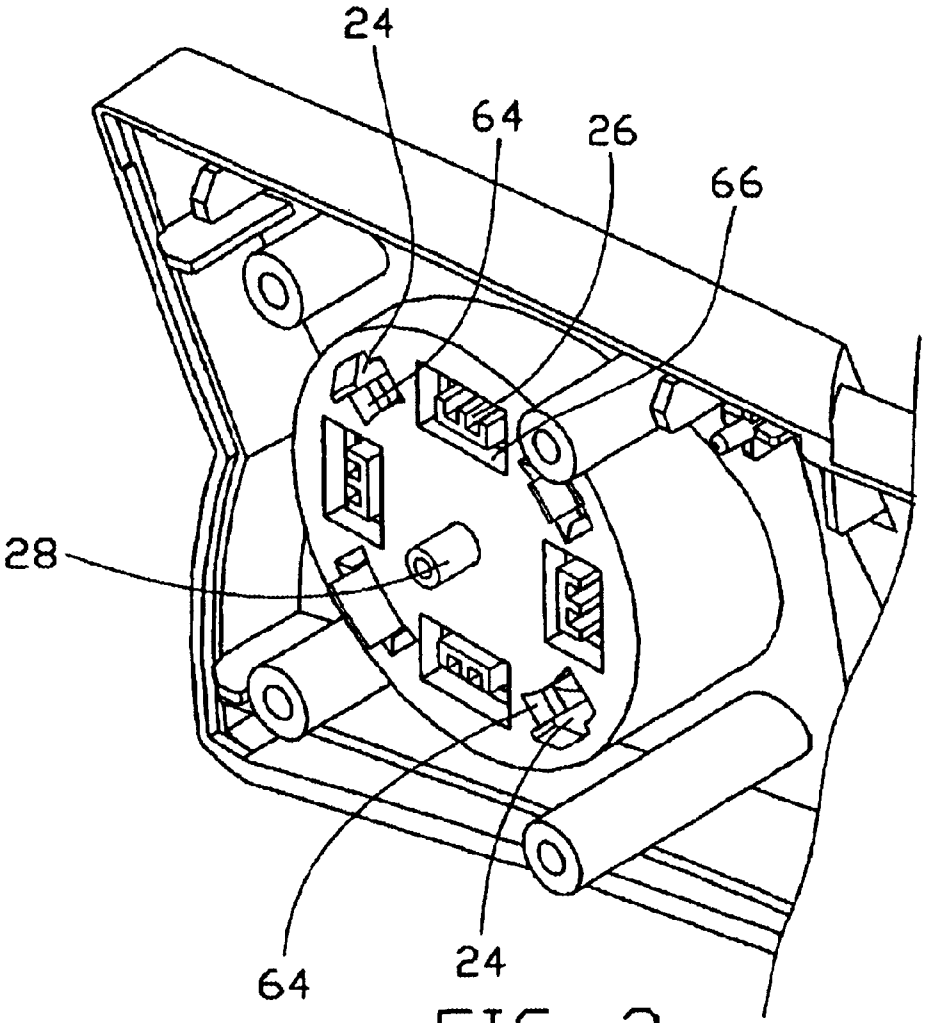
FIG. 3 is an assembled view of FIG. 2.

Referring also to FIG. 3, in assembly, the spring 40 is firstly placed over the guiding sleeve 30 of the button 20. Then the locking hooks 24 of the button 20 are engagingly extended into the corresponding locking apertures 64 of the receiving portion 62. The contacting blocks 26 and the contacting pole 28 extend into the corresponding holes 66 and the through hole 68 respectively. The guiding sleeve 30 is accommodated in the annular groove 70. The button 20 is thereby attached to the bezel 60. In operation, one of the functional symbols is depressed to switch on the corresponding controlling point 92 of the circuit board 90, thereby obtaining the desired function.

Figure 4:
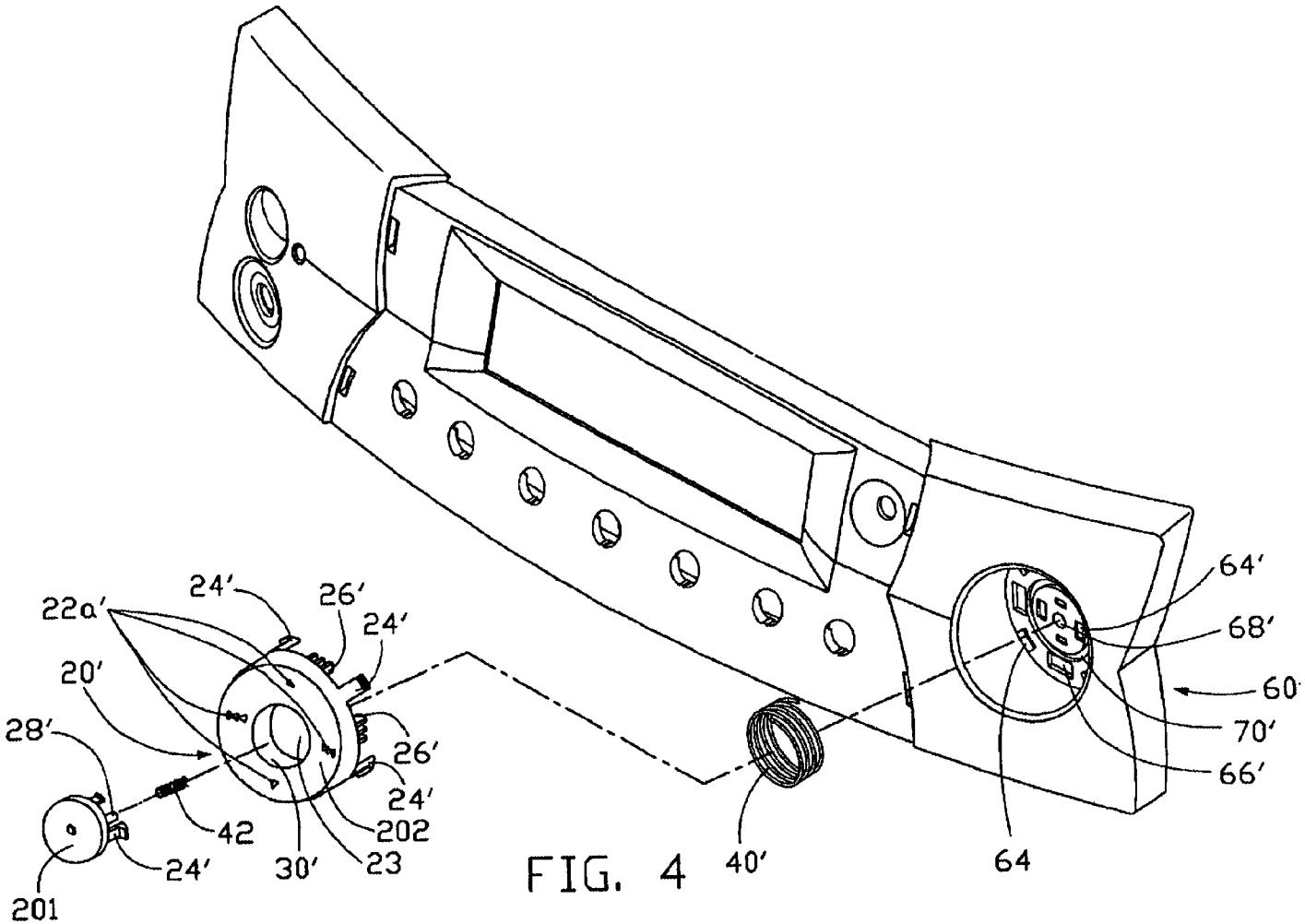
FIG. 4 is an exploded view of a button device in accordance with an alternative embodiment of the present invention, together with a computer bezel.
Figure 5:
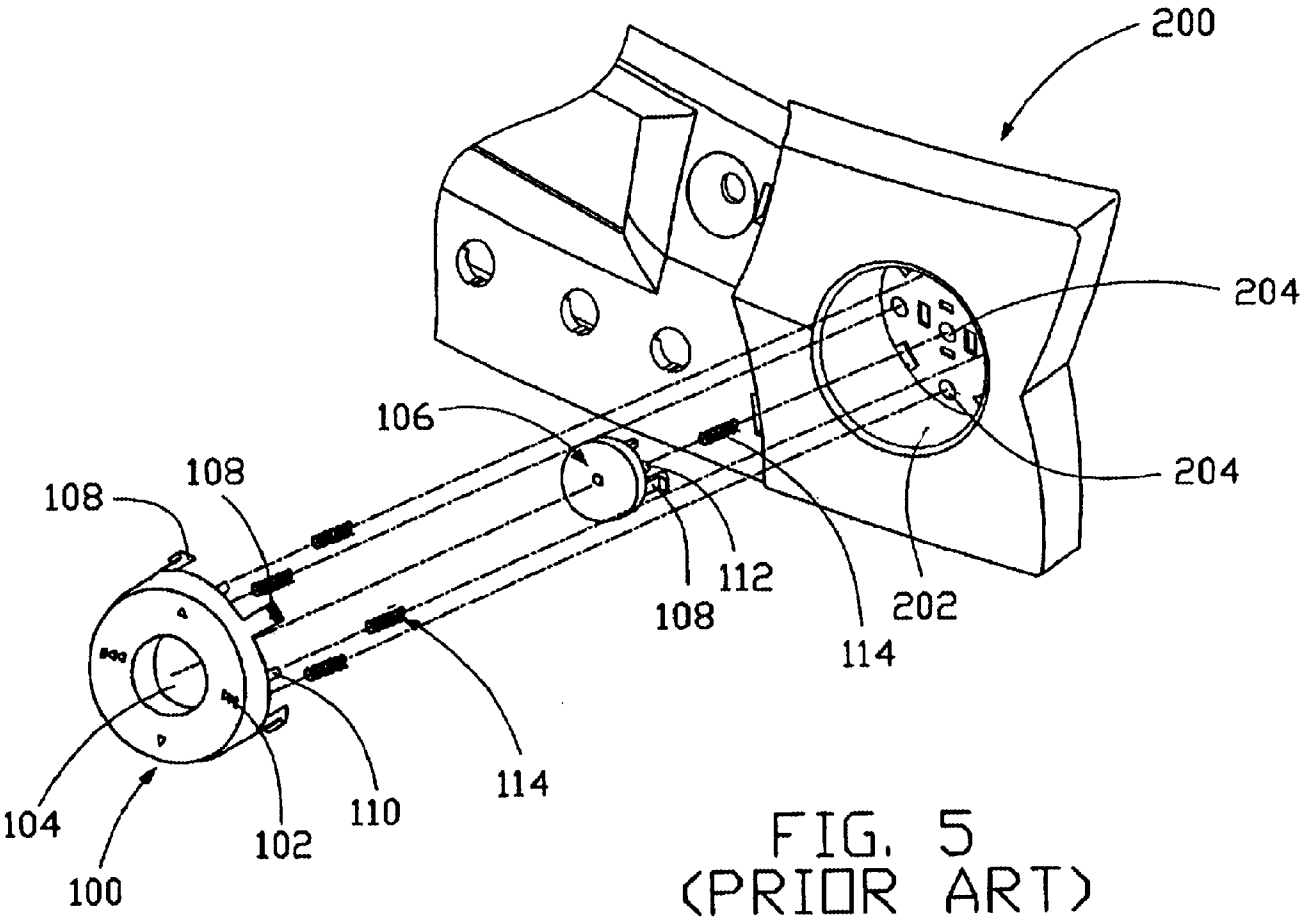
FIG. 5 (PRIOR ART)
FIG. 5 is an exploded view of a conventional button device.

Referring to FIG. 4, a button device 20' in accordance with an alternative embodiment of the present invention comprises a main button 202, and a middle button 201 inserted into a central hole 23 of the main button 202. Locking hooks 24' and contacting blocks 26' of the main button 202 are the same as the locking hooks 24 and the contacting blocks 26 of the button 20 of the preferred embodiment. An annular sleeve 30' is rearwardly formed from a periphery of the central hole 30', and partly accommodated in an annular groove 70' of a computer bezel 60'. A big spring 40' is partly placed around the annular sleeve 30'. The middle button 201 has a plurality of locking hooks 24' engaging in corresponding locking apertures 64' of the bezel 60'. A contacting pole 28∝ extends rearwardly from the middle button 201 and into a corresponding through hole 68' of the bezel 60'. A small spring 42 is placed over the contacting pole 28'. A plurality of functional symbols 22*a'* is formed on a face of the main button 202 and the middle button 201, corresponding to the contacting blocks 26' and the contacting pole 28'.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A button device adapted to be incorporated in a bezel to switch a controlling points on a circuit board the button device comprising:

a button having a base, a plurality of contacting blocks extending rearwardly from a back of the base, and an annular guiding sleeve extending rearwardly from a middle portion of the back of the base, each of said contacting blocks being adapted to switch a corresponding controlling point;

a spring placed over the annular guiding sleeve; and a receiving portion for accommodating the button, the receiving portion being adapted to be formed in the bezel, the receiving portion defining a plurality of holes for extension of the contacting blocks therethrough to switch the corresponding controlling points.

2. The button device as described in claim 1, wherein a plurality of locking hooks extends rearwardly from a periphery of the back of the base.

3. The button device as described in claim 2, wherein a plurality of locking apertures is defined in the receiving portion, for extension of the locking hooks thereinto.

4. The button device as described in claim 1, wherein an annular groove is defined in a rearmost part of the receiving portion, for accommodating the guiding sleeve of the button.

5. The button device as described in claim 4, wherein the button further comprises a contacting pole extending rearwardly from a middle of the back of the base and into a corresponding hole defined in the receiving portion and surrounded by the groove.

6. The button device as described in claim 1, wherein the button further defines a central hole, and has an annular sleeve extending rearwardly from a periphery of the central hole, and wherein a middle button is accommodated in the central hole.

7. The button device as described in claim 6, wherein the middle button has a contacting pole extending rearwardly from a middle of the middle button and into a corresponding hole defined in the receiving portion.

8. A button controlling system, comprising:

a button comprising a base, a plurality of functional symbols formed on a face of the base, a plurality of contacting blocks corresponding to the symbols and extending rearwardly from a back of the base, and an annular guiding sleeve extending rearwardly from the back of the base surrounded by the contacting blocks;

a spring placed over the guiding sleeve;

a bezel having an indented receiving portion formed therein for accommodating the button and the spring, a plurality of holes being defined in a rearmost part of the receiving portion for extension of the contacting blocks therethrough; and a controlling circuit placed behind the bezel, the circuit having a plurality of controlling points corresponding to the boles of the bezel, wherein when one of the symbols is pressed, a corresponding contacting block pushes a corresponding controlling point.

9. The button controlling system as described in claim 8, wherein a plurality of hooks extends rearwardly from a periphery of the back of the base of the button and engagingly extends through a plurality of apertures defined in the rearmost part of the receiving portion.

10. The button controlling system as described in claim 8, wherein the symbols on the face of the button further comprise a central symbol which corresponds to a contacting pole extending rearwardly from the back of the base, and wherein a hole is defined in a middle of the rearmost part of the receiving portion for extension of the contacting pole thereinto.

11. The button controlling system as described in claim 10, wherein the contacting pole is longer than the contacting blocks.

12. The button controlling system as described in claim 8, wherein an annular groove is defined in the rearmost part of the receiving portion, for accommodating the guiding sleeve of the button.

13. The button controlling system as described in claim 8, wherein the button further defines a central hole for accommodating a middle button therein, the middle button has a contacting pole extending rearwardly from a middle of the middle button, and a small spring is placed over the contacting pole.

14. The assembly as described in claim 8, wherein the annular guiding sleeve extends rearwardly from a middle portion of the back of the base and surround the contacting pole.

15. The assembly as described in claim 8, further including a plurality of locking hooks integrally extending from the button and circumferentially alternately arranged with said plurality of contacting blocks with a substantially same diameter thereof so as to commonly leave a sufficient internal space for receiving the spring therein.

16. A bezel and button device assembly, comprising:

a bezel having an indented receiving portion formed therein, the receiving portion having a rear part defining a middle through hole, a groove around the through hole and a plurality of holes around the groove; and a push button received in the receiving portion, comprising a base adapted to receive a push force, a plurality of contacting blocks extending rearwardly from a periphery of the base through the holes of the rear part of the receiving portion, a sleeve extending rearwardly from a middle of the base and received in the groove, and a contact pole extending rearwardly from the base and received in the middle through hole; and a spring placed over the sleeve to provide a spring force to the push button.

17. The assembly as described in claim 16, wherein the push button further comprises at least a hook engaging with the receiving portion of the bezel.

18. The assembly as described in claim 16, further including a plurality of locking hooks integrally extending from the push button and circumferentially alternately arranged with said plurality of contacting blocks with a substantially same diameter thereof so as to commonly leave a sufficient internal space for receiving the spring therein.

* * * * *